US009087483B2

(12) United States Patent
Kim et al.

(10) Patent No.: US 9,087,483 B2
(45) Date of Patent: Jul. 21, 2015

(54) ORGANIC LIGHT EMITTING DISPLAY DEVICE

(71) Applicant: LG DISPLAY CO., LTD., Seoul (KR)

(72) Inventors: Binn Kim, Seoul (KR); Juhn Suk Yoo, Goyang-si (KR); Bu Yeol Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 47 days.

(21) Appl. No.: 13/850,639

(22) Filed: Mar. 26, 2013

(65) Prior Publication Data

US 2013/0257831 A1 Oct. 3, 2013

(30) Foreign Application Priority Data

Mar. 27, 2012 (KR) ..... 10-2012-0030867

(51) Int. Cl.
*G09G 3/30* (2006.01)
*G09G 3/32* (2006.01)

(52) U.S. Cl.
CPC ..... *G09G 3/3266* (2013.01); *G09G 3/3233* (2013.01); *G09G 2300/0861* (2013.01); *G09G 2320/029* (2013.01)

(58) Field of Classification Search
CPC ..... G09G 2330/021; G09G 2300/0842; G09G 2320/0626; G09G 3/3233; G09G 3/3648; G09G 2300/0417; G09G 2300/0819; G09G 2320/029; G09G 2320/0295; G09G 2300/0861; G09G 2320/045; G09G 2320/043; G09G 3/3291; G09G 2310/0262; G09G 2320/041; G09G 2310/0251; G09G 2320/0285; G06F 3/0412; G06F 15/16; G06F 21/83; G06F 3/03545; G06F 3/042; G06F 3/044; G06F 3/0488; G06F 3/04883; G06F 1/3218; G06F 1/3234; G06F 3/0416; G06F 2203/04106; G06F 3/0414; G06F 19/3412; G06F 19/3456; G06F 19/3481; G06F 3/01; G06F 3/041; G06F 3/0418; G06F 3/046
USPC ..... 345/76–84
See application file for complete search history.

(56) References Cited

U.S. PATENT DOCUMENTS 8,149,189 B2 4/2012 Kim et al.
8,354,984 B2 1/2013 Choi
(Continued)

FOREIGN PATENT DOCUMENTS

CN 1773593 A 5/2006
CN 1909038 A 2/2007
(Continued)

OTHER PUBLICATIONS

Office Action and Search Report issued in Chinese Patent Application No. 201310098650.X, mailed Dec. 3, 2014, 6 pages.

*Primary Examiner* — Duc Dinh
(74) *Attorney, Agent, or Firm* — Brinks Gilson & Lione

(57) ABSTRACT

An organic light emitting display device includes: a plurality of pixel regions. Each of the pixel regions includes: a first transistor configured to apply a data voltage on a first adjacent data line to a first node in response to a scan signal on the primary scan line; a second transistor configured to apply the data voltage on the first adjacent data line to the first node in response to a sensing signal on the secondary scan line; and a third transistor configured to detect a sensing voltage and apply the sensing voltage to a second adjacent data line, The data driver compares the sensing voltage and the data voltage and compensates for the data voltage of next frame, and the scan signal and the sensing signal are generated in different intervals of a single frame.

13 Claims, 5 Drawing Sheets

(56) References Cited

U.S. PATENT DOCUMENTS

| | | | | |
|---|---|---|---|---|
| 8,593,378 | B2 | 11/2013 | Ryu et al. | |
| 2008/0001857 | A1 | 1/2008 | Yoo | |
| 2010/0073335 | A1* | 3/2010 | Min et al. | 345/204 |

FOREIGN PATENT DOCUMENTS

| | | | |
|---|---|---|---|
| CN | 1963905 | A | 5/2007 |
| JP | 2009163275 | A | 7/2009 |
| KR | 20100047961 | A | 5/2010 |

* cited by examiner

ORGANIC LIGHT EMITTING DISPLAY DEVICE

The present application claims priority under 35 U.S.C. 119(a) of Korean Patent Application No. 10-2012-0030867 filed on Mar. 27, 2012, which is hereby incorporated by reference in its entirety.

BACKGROUND

1. Field of the Disclosure

The present disclosure relates to an organic light emitting display device.

2. Description of the Related Art

Display devices for displaying information are being widely developed. The display devices include liquid crystal display devices, organic light-emitting display devices, electrophoresis display devices, field emission display devices, and plasma display devices.

Among these display devices, organic light-emitting display devices have the features of lower power consumption, wider viewing angle, lighter weight and higher brightness compared to the liquid crystal display devices. As such, the organic light-emitting display device is considered to be next generation display devices.

Thin film transistors used in the organic light-emitting display device can be driven at a high speed. To this end, the thin film transistors increase carrier mobility using a semiconductor layer, which is formed from polysilicon. Polysilicon can be derived from amorphous silicon through a crystallizing process.

A laser scanning mode is widely used in the crystallizing process. During such a crystallizing process, the power of a laser beam can be unstable. As such, the thin film transistors formed on the scanned line, which is scanned by the laser beam, can have different threshold voltages from each other. This can cause image quality to be non-uniform between pixel regions.

To address this matter, a technology detecting the threshold voltages of pixel regions and compensating for the threshold voltages of thin film transistors had been proposed.

For the detection of the threshold voltage, the proposed technology applies a sensing signal to pixels on a row line to which a scan signal is not applied. In other words, the sensing signal and the scan signal are simultaneously applied to the pixels on the different row lines. Due to this, a signaling scheme can be complex, and the circuit configuration of a scan driver can also become complex.

SUMMARY

According to a first general aspect of the present embodiment, an organic light emitting display device includes: a plurality of primary scan lines and a plurality of secondary scan lines; a plurality of data lines connected to a data driver and arranged in such a manner as to cross the primary and secondary scan lines; and a plurality of pixel regions defined by the scan lines and the data lines crossing each other. The each of the pixel regions includes: a first transistor configured to apply a data voltage on a first adjacent data line to a first node in response to a scan signal on the primary scan line; a drive transistor configured to generate a drive current corresponding to the data voltage at the first node; an organic light emission element configured to emit light by the drive current; a second transistor configured to apply the data voltage on the first adjacent data line to the first node in response to a sensing signal on the secondary scan line; and a third transistor configured to detect a sensing voltage and apply the sensing voltage to a second adjacent data line, in response to the sensing signal on the secondary scan line. The data driver compares the sensing voltage and the data voltage and compensates for the data voltage of next frame, and the scan signal and the sensing signal are generated in different intervals of a single frame.

An organic light-emitting display device according to another aspect of the present embodiment includes: a plurality of primary scan lines and a plurality of secondary scan lines; a plurality of data lines arranged in such a manner as to cross the primary and secondary scan lines; and a plurality of pixel regions defined by the scan lines and the data lines crossing each other and each connected between two adjacent data lines, wherein the primary scan lines are sequentially driven every frame, the secondary scan lines are sequentially driven one by one along frames, and each of the pixel regions receives a data voltage on one of the adjacent data lines when the respective primary scan line is driven and applies a sensing voltage to the other one of the adjacent data lines when the respective secondary scan line is driven.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
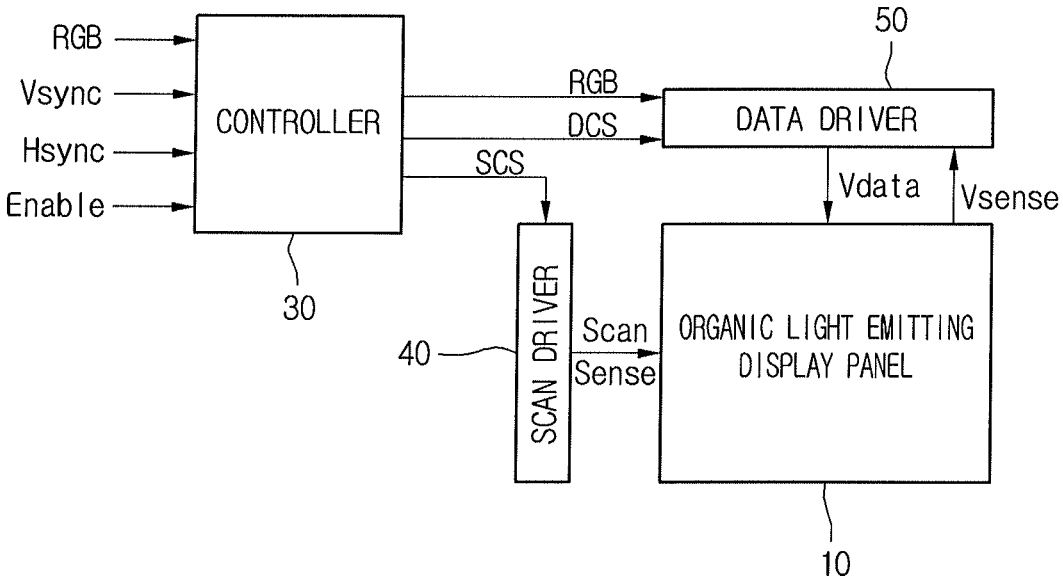
FIG. 1 is a block diagram showing an organic light emitting display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing an OLED device according to an embodiment of the present disclosure.

Referring to FIG. 1, the organic light emitting display device according to an embodiment of the present disclosure can include an organic light emitting display panel 10, a controller 30, a scan driver 40 and a data driver 50.

The controller 30 receives video data RGB, a horizontal synchronous signal Hsync, a vertical synchronous signal Vsync and an enable signal Enable from the exterior. Also, the controller 30 generates scan control signals SCS used to drive the scan driver 40, and data control signals DCS used to drive the data driver 50. Moreover, the controller 30 applies the scan control signals SCS to the scan driver 40, and supplies the video data RGB and the data control signals DCS to the data driver 50.

The scan control signals DSC can include a gate start pulse GSP, a gate shift clock GSC and a gate output enable signal GOE. The data control signals DSC can include a source shift clock, a source start pulse SSP, a polarity control signal POL and a source output enable signal SOE.

The scan driver 40 generates scan signals Scan and a sensing signal Sense using the scan control signals SCS. The scan signals Scan and the sensing signal Sense can be applied from the scan driver 40 to the organic light emitting display panel 10.

The data driver 50 can derive data voltages Vdata from the video data RGB using the data control signals DCS. The data voltages Vdata can be applied from the data driver 50 to the organic light emitting display panel 10.

The organic light emitting display panel 10 can detect sensing voltages Vsense in response to the sensing signal Sense from the scan driver 40 and apply the detected sensing voltages Vsense to the data driver 50. The data driver 50 can compensate for the data voltages Vdata of the next frame using the sensing voltages Vsense of the current frame. The sensing voltages Vsense for a single scan line of pixels can be sensed every frame. The detection of the sensing voltages Vsense using the sensing signal Sense will be described later.

Figure 2:
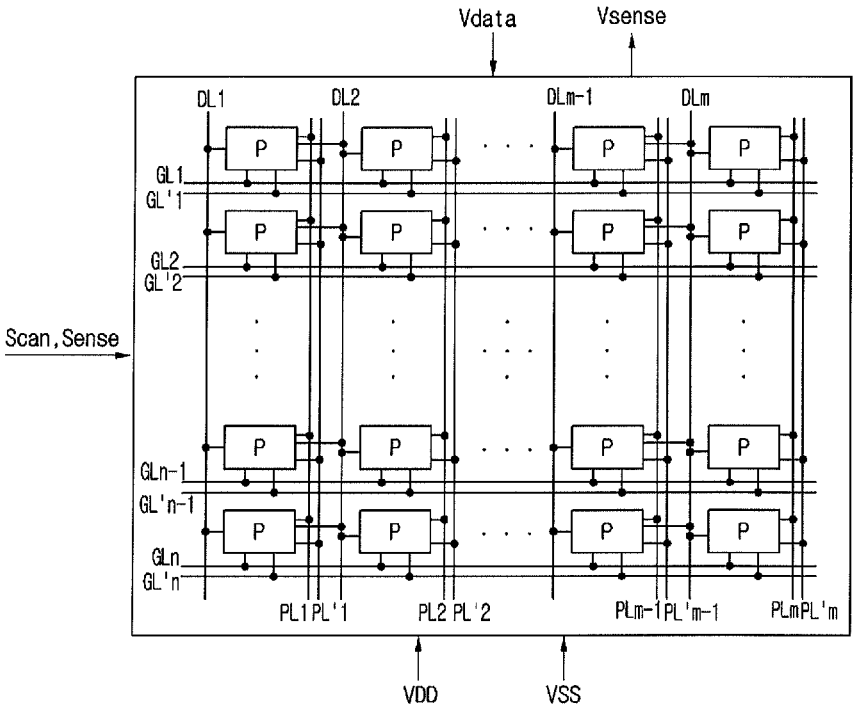
FIG. 2 is a configuration diagram showing the organic light emitting display panel in FIG. 1.

FIG. 2 is a configuration diagram showing the OLED panel in FIG. 1.

Referring to FIG. 2, the organic light emitting display panel 10 of the present embodiment can include a plurality of primary scan lines GL1~GLn, a plurality of secondary scan lines GL'1~GL'n, a plurality of data line DL1~DLm, a plurality of primary power voltage lines PL1~PLm, and a plurality of secondary power voltage lines PL'1~PL'm. Although it is not shown in the drawing, the organic light emitting display panel 10 can further include a plurality of signal lines, as needed.

A plurality of pixel regions P can be defined by the primary scan lines GL1~GLn and the data lines DL1~DLm crossing each other. Each of the pixel regions P can be electrically connected to one of the primary scan lines GL1~GLn, one of the secondary scan lines GL'1~GL'n, one of the data line DL1~DLm, one of the primary power voltage lines PL1~PLm, and one of the secondary power voltage lines PL'1~PL'm.

For example, each of the primary scan lines GL1~GLn and each of the secondary scan lines GL'1~GL'n can be electrically connected to the pixel regions P arranged in a horizontal direction. Also, each of the data lines DL1~DLm can be electrically connected to the pixel regions P arranged in a vertical direction.

As such, each of the pixel regions P can receive the scan signal Scan, the sensing signal Sense, the data voltage Vdata, a high power supply voltage VDD and a low power supply voltage VSS.

The scan signal Scan can be applied from the gate driver 40 to the pixel region P through one the primary scan lines GL1~GLn. The sensing signal Sense can be applied from the gate driver 40 to the pixel region P through one of the secondary scan lines GL'1~GL'n.

The data voltage Vdata can be applied from the data driver 50 to the pixel region P through one of the data lines DL1~DLm. The pixel region P can apply the sensing voltage Vsense to the data driver 50 through one of the data lines DL1~DLm.

The high power supply voltage VDD can be applied to the pixel region P through one of the primary power voltage lines PL1~PLm. The low power supply voltage VSS can be applied to the pixel region P through one of the secondary power voltage lines PL'1~PL'm.

Figure 3:
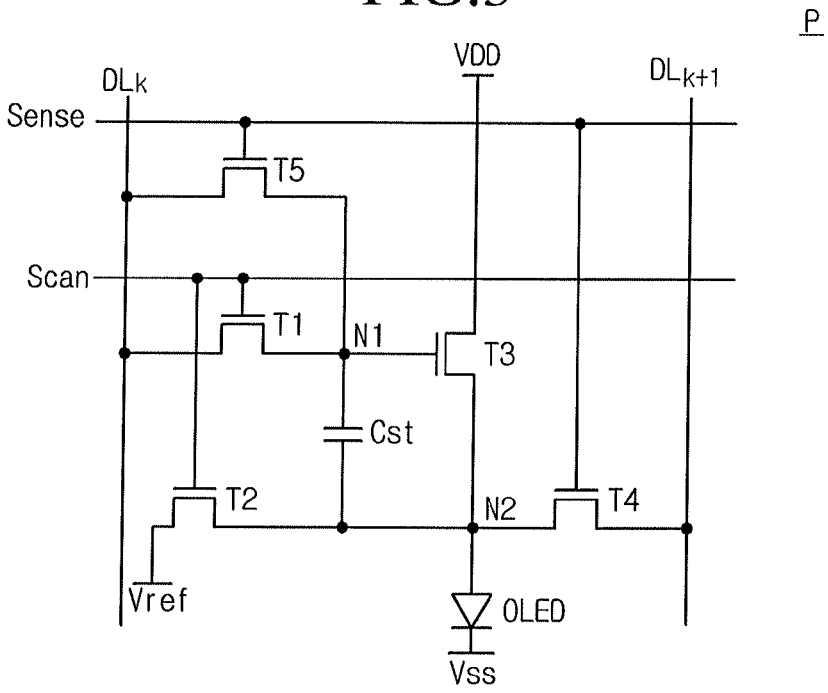
FIG. 3 is a circuit diagram showing a single pixel region of the organic light emitting display panel in FIG. 2.

FIG. 3 is a circuit diagram showing a single pixel region of the organic light emitting display panel in FIG. 2.

Referring to FIG. 3, the pixel region P of the organic light emitting display panel 10 according to an embodiment of the present disclosure can be configured to include first through fifth transistors T1~T5, a storage capacitor Cst and an organic light emission element OLED. However, the present embodiment is not limited to this. In other words, the number of transistors and the connection configuration therebetween within a single pixel region P can be modified in a variety of shapes by circuit designers. Therefore, the present embodiment can be applied to every modifiable circuit configuration of the pixel region P being designed by the circuit designers.

The first, second, fourth and fifth transistors T1, T2, T4 and T5 can become switching transistors used to transfer signals. The third transistor T3 can be a drive transistor used to generate a drive current for which drives the organic light emission element OLED to emit light.

The storage capacitor Cst can serves the function of maintaining the data voltage Vdata for a single frame period.

The organic light emission element OLED is a device that is configured to emit light. The organic light emission element OLED can emit light whose brightness or a gray level varies with intensity of the drive current. Such an organic light emission element OLED can include one of a red organic light emission element OLED that is configured to emit red light, a green organic light emission element OLED that is configured to emit green light, and a blue organic light emission element OLED that is configured to emit blue light.

The first through fifth transistors T1~T5 can be NMOS-type thin film transistors, but it is not limited to this. The first through fifth transistors T1~T5 can be turned-on by a high level signal and turned-off by a low level signal.

The high power supply voltage VDD can be a high level signal. The low power supply voltage VSS can be a low level signal. The high and low power supply voltages VDD and VSS can be DC (Direct Current) voltages maintaining fixed levels, respectively.

A gate electrode of the first transistor T1 can be connected to one of the primary scan lines GL1~GLn to which the scan signal Scan is applied. A drain electrode of the first transistor T1 can be connected to a kth data line DLk. A source electrode of the first transistor T1 can be connected to a first node N1.

A gate electrode of the second transistor T2 can be connected to one of the primary scan lines GL1~GLn to which the scan signal Scan is applied. A drain electrode of the second transistor T2 can be connected to a reference voltage line to which a reference voltage Vref is applied. A source electrode of the second transistor T2 can be connected to a second node N2.

A gate electrode of the third transistor T3 can be connected to the first node N1. A drain electrode of the third transistor T3 can be connected to one of the primary power voltage lines PL1~PLn to which the high power supply voltage VDD is applied. A source electrode of the third transistor T3 can be connected to the second node N2.

A gate electrode of the fourth transistor T4 can be connected to one of the secondary scan lines GL'1~GL'n to which the sensing signal Sense is applied. A drain electrode of the fourth transistor T4 can be connected to the second node N2. A source electrode of the fourth transistor T4 can be connected to a (k+1)th data line DLk+1.

A gate electrode of the fifth transistor T5 can be connected to one of the secondary scan lines GL'1~GL'n to which the sensing signal Sense is applied. A drain electrode of the fifth transistor T5 can be connected to the kth data line DLk. A source electrode of the fifth transistor T5 can be connected to the first node N1.

The storage capacitor Cst can be connected between the first and second nodes N1 and N2. The storage capacitor Cst serves the function of maintaining the data voltage Vdata for a single frame period.

The organic light emission element OLED can be connected between the second node N2 and one of the secondary power voltage lines PL'1~PL'n to which the low power supply voltage VSS is applied.

The first node N1 can be commonly connected to the source electrode of the first transistor T1, a first electrode of the storage capacitor Cst, the gate electrode of the third transistor T3 and the source electrode of the fifth transistor T5.

The second node N2 can be commonly connected to the source electrode of the second transistor T2, the source electrode of the third transistor T3, the drain electrode of the fourth transistor T4, a second electrode of the storage capacitor Cst and an anode of the organic light emission element OLED.

The first transistor T1 can be turned-on by the scan signal Scan of a high level applied from one of the primary scan lines GL1~GLn. As such, the data voltage Vdata used to display an image can be transferred from the kth data line DLk to the first node N1 through the turned-on first transistor T1.

The second transistor T2 can also be turned-on by the scan signal Scan of the high level applied from one of the primary scan lines GL1~GLn. As such, the reference voltage Vref on the reference voltage line can be transferred to the second node N2 through the turned-on second transistor T2.

Although the first and second transistors T1 and T2 are connected to the same scan line GL, they can be connected to different scan lines. In other words, the first and second transistors T1 and T2 can receive different scan signals.

Also, the second transistor T2 can be removed from the pixel region P. In this case, the second node N2 can be connected to the reference voltage line and directly receive the reference voltage Vref.

The third transistor T3 can generate a drive current in accordance with a difference between a voltage at the first node N1 and another voltage at the second node N2. The drive current generated in the third transistor T3 can be applied to the organic light emission element OLED. As such, the organic light emission element OLED can emit light whose brightness or a gray level corresponds to the drive current applied from the third transistor T3.

The fourth transistor T4 can be turned-on by the sensing signal Sense of a high level applied from one of the secondary scan lines GL'1~GL'n. As such, the voltage at the second node N2 can be transferred to the (k+1)th data line DLk+1 through the turned-on fourth transistor T4.

The fifth transistor T5 can be turned-on by the sensing signal Sense of the high level applied from one of the secondary scan lines GL'1~GL'n. As such, the data voltage Vdata on the kth data line DLk can be transferred to the first node N1 through the turned-on fifth transistor T5.

The organic light emitting display device of the present embodiment can allow the fourth and fifth transistors T4 and T5 to be switched in a synchronized mode, in order to sense a threshold voltage. As such, the organic light emitting display device can compensate for the data voltage on the basis of the sensed threshold voltage. Moreover, the organic light emitting display device can employ a smaller transistor in comparison with the third transistor, which generates the drive current.

Figure 4:
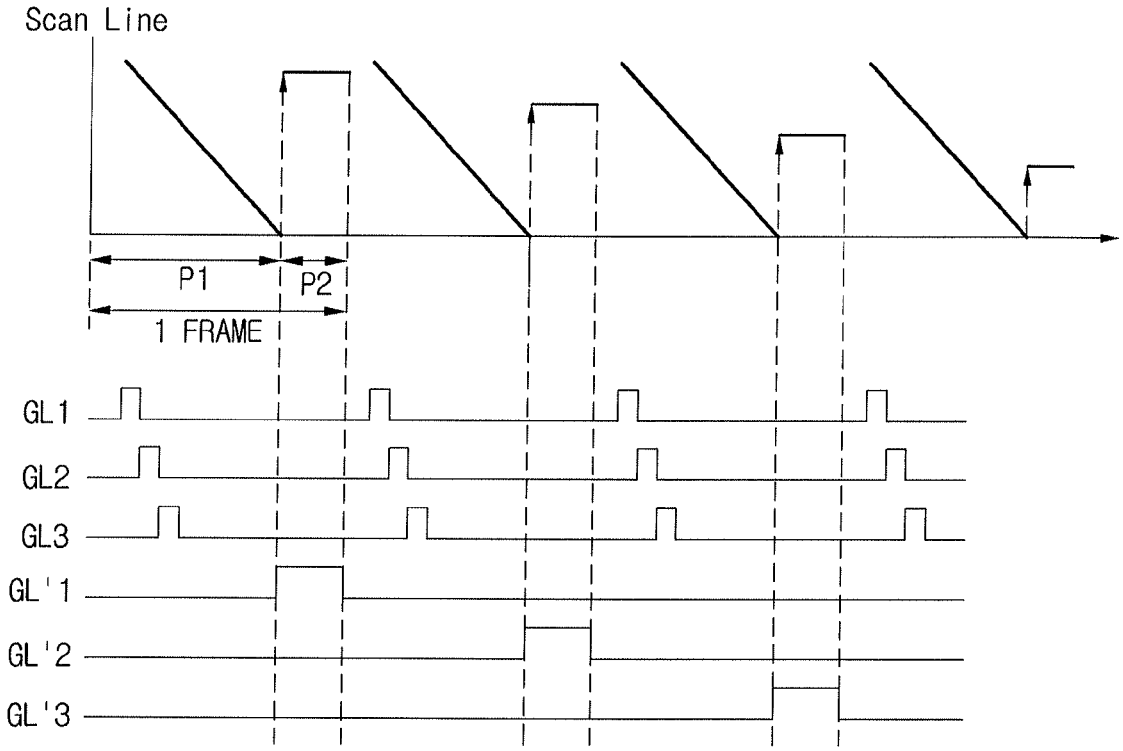
FIG. 4 is a waveform diagram showing signals used to drive the organic light emitting display device according to an embodiment of the present disclosure.

FIG. 4 is a waveform diagram showing signals used to drive the OLED device according to a first embodiment of the present disclosure; and The circuit within the pixel region P can be separately driven in two intervals during a single frame.

A first interval P1 corresponds to an emission interval enabling the organic light emission element OLED to emit light. In the first interval, the data voltages Vdata are applied to the pixel regions P in synchronization with the scan signal which is sequentially applied to the primary scan lines GL1~GLn. A second interval P2 corresponds to a sensing period allowing the sensing voltage Vsense to be detected by the sensing signal Sense and provide as a threshold voltage of the third transistor T3.

In each frame, the scan signals Scan can be sequentially applied to the plurality of primary scan lines GL1~GLn. Meanwhile, the sensing signal Sense can be applied only one of the plurality of secondary scan lines GL'1~GL'n in each frame.

For example, the sensing signal Sense can be applied to a first secondary scan line GL'1 in the second interval of a first frame. In the second interval of a second frame, the sensing signal Sense can be applied to a second secondary scan line GL'2. The sensing signal Sense can be applied to a third secondary scan line GL'3 in the second interval of a third frame.

The sensing voltages Vsense can be applied from the pixel regions connected to the first secondary scan line GL'1 to the data driver 50 in the second interval of the first frame. In the second interval of the second frame, the sensing voltages Vsense can be applied from the pixel regions P connected to the second secondary scan line GL'2 to the data driver 50. During the second interval of the third frame, the sensing voltages can be applied from the pixel regions P connected to the third secondary scan line GL'3 to the data driver 50. In this manner, the threshold voltages of the third transistors T3 sensed from each row can be applied to the data driver 50 during the second interval of each frame.

The organic light emitting display device of the present embodiment enables the scan signal and the sensing signal to be applied through the scan lines separated from each other. As such, the organic light emitting display device can be driven in such a manner that the scan signals with the same pulse width are applied to the scan lines. In accordance therewith, the number of scan driver IC (integrated circuit) chip or the number of channels in the scan driver can be reduced. In other words, the configuration of the scan driver can be simplified. As a result, the scan driver can be formed on the organic light emitting display panel as an internal circuit of the display panel.

Figure 5A:
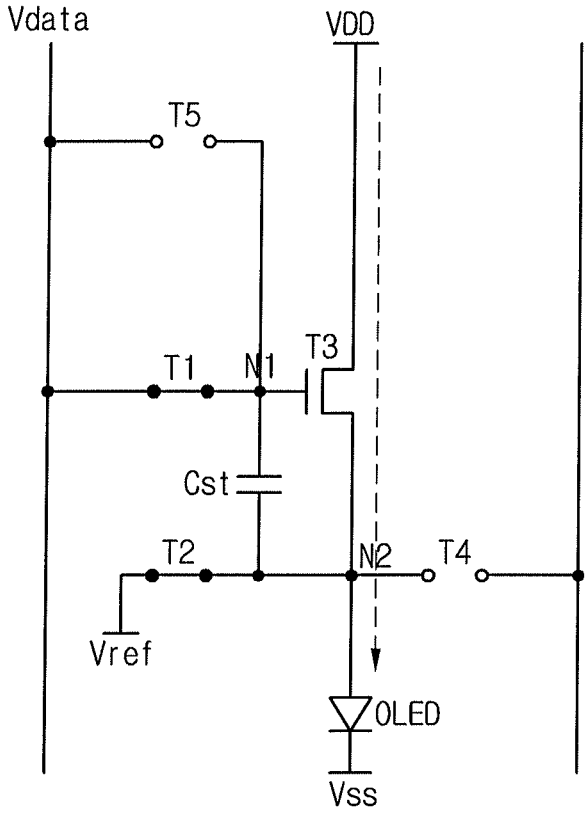
FIGS. 5A and 5B are circuit diagrams illustrating operations of the pixel region in FIG. 3, in intervals.
Figure 5B:
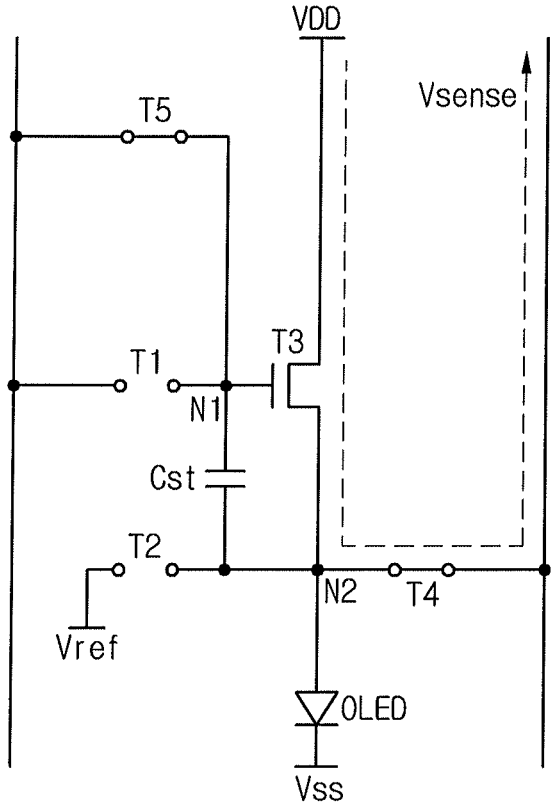

FIGS. 5A and 5B are circuit diagrams illustrating each interval operation of the pixel region according to an embodiment of the present disclosure. FIG. 5A is a circuit diagram showing a first interval operation state of the pixel region according to an embodiment of the present disclosure, and FIG. 5B is a circuit diagram showing a second interval operation state of the pixel region according to an embodiment of the present disclosure.

As shown in FIG. 5A, the scan signals Scan each having a high level can be sequentially applied to the primary scan lines GL1~GLn in the first interval P1.

The first and second transistors T1 and T2 within each pixel region P can be turned-on by the scan signal Scan of the high level. Meanwhile, the fourth and fifth transistors T4 and T5 within each pixel region P can be turned-off by the sensing signal Sense of the low level.

The data voltage Vdata on the data line DL can be applied to the gate electrode of the third transistor T3 through the turned-on first transistor T1 and the first node N1. Also, the reference voltage Vref on the reference voltage line can be applied to the second node N2 through the turned-on second transistor T2. As such, the third transistor T3 can supply the organic light emission element OLED with a drive current corresponding to a difference between the data voltage Vdata at the first node N1 and the reference voltage Vref at the second node N2. In accordance therewith, the organic light emission element OLED can emit light by the drive current from the third transistor T3.

In the second interval P2 of each frame, the sensing signal Sense of the high level can be applied to one of the secondary scan lines GL'1~GL'n.

The first and second transistors T1 and T2 can be turned-off because of the scan signal Scan of the low level. Meanwhile, the fourth and fifth transistors T4 and T5 can be turned-on by the sensing signal Sense of the high level.

The data voltage Vdata on the data line DLk can be applied to the gate electrode of the third transistor T3 through the turned-on fourth fifth transistor T5 and the first node N1. Also, a sensing voltage Vsense at the second node N2 can be applied to the data driver 50 through the turned-on fourth transistor T4 and the (k+1)th data line DLk+1.

The data driver 50 can detect a threshold voltage by comparing the data voltage Vdata, which is applied to the kth data line DLk, and the sensing voltage Vsense on the (k+1)th data line DLk+1. Also, the data driver 50 can compensate the data voltage Vdata of the next frame with the detected threshold voltage and apply the compensated data voltage to the kth data line (DLk).

The compensation of the data voltage can prevent non-uniformity between pixels, which can be caused by a threshold voltage difference. Therefore, picture quality can be enhanced.

Also, the organic light emitting display device of the present embodiment enables the scan signal and the sensing signal to be applied through the scan lines separated from each other. As such, the configuration of the scan driver can be simplified. In other words, the number of scan driver IC (integrated circuit) chip or the number of channels in the scan driver can be reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display device comprising:

a plurality of primary scan lines and a plurality of secondary scan lines;

a plurality of data lines connected to a data driver and arranged in such a manner as to cross the primary and secondary scan lines; and a plurality of pixel regions defined by the scan lines and the data lines crossing each other and configured to each include, a first transistor configured to apply a data voltage on a first adjacent data line to a first node in response to a scan signal on the primary scan line, a drive transistor configured to generate a drive current corresponding to the data voltage at the first node, an organic light emission element configured to emit light by the drive current, a second transistor configured to apply the data voltage on the first adjacent data line to the first node in response to a sensing signal on the secondary scan line, and a third transistor configured to detect a sensing voltage and apply the sensing voltage to a second adjacent data line, in response to the sensing signal on the secondary scan line, wherein the data driver compares the sensing voltage of current frame and the data voltage of current frame and compensates for the data voltage of next frame, and the scan signal and the sensing signal are generated in different intervals of a single frame.

2. The organic light-emitting display device of claim 1, wherein the pixel region further includes a second node connected to a source electrode of the drive transistor and the organic light emission element, and the sensing voltage is a voltage of the second node.

3. The organic light-emitting display device of claim 1, wherein the single frame is defined into first and second intervals, the scan signal maintains a high level during a fixed period of the first interval, and the sensing signal maintains the high level during the fixed period of the second interval.

4. The organic light-emitting display device of claim 3, wherein the sensing voltage is detected only from the pixel region connected to one of the secondary scan lines during the second interval of the single frame.

5. The organic light-emitting display device of claim 4, wherein the sensing signal of the high level is sequentially applied to the plurality of secondary scan lines along the frames.

6. The organic light-emitting display device of claim 2, wherein the pixel region further includes a storage capacitor connected between the first and second nodes and configured to maintain the data voltage.

7. The organic light-emitting display device of claim 2, wherein the pixel region further includes a fourth transistor configured to transfer a reference voltage to the second node in response to the scan signal.

8. An organic light-emitting display device comprising:

a plurality of primary scan lines and a plurality of secondary scan lines;

a plurality of data lines for supplying a data voltage arranged in such a manner as to cross the primary and secondary scan lines; and a plurality of pixel regions defined by the scan lines and the data lines crossing each other and each connected between adjacent first and second data lines of the data lines, wherein the primary scan lines are sequentially driven every frame, only one of the secondary scan lines is driven in a frame and the secondary scan lines are sequentially driven one by one along frames, and each of the pixel regions receives a data voltage on the first data line when the respective primary scan line is driven and applies a sensing voltage to the second data line when the respective secondary scan line is driven, and wherein a first data line of the plurality of data lines supplies a data voltage to the pixel regions when the respective primary scan line is driven and a second data line of the plurality of data lines receives a sensing voltage when the respective secondary scan line is driven.

9. The organic light-emitting display device of claim 8, wherein each of the frames is defined into first and second intervals, the primary scan lines are sequentially driven during the first interval, and one of the secondary scan lines is driven during the second interval.

10. The organic light-emitting display device of claim 8, wherein the pixel region includes:

a first transistor configured to apply the data voltage on one of the adjacent data lines to a first node in response to a scan signal on the primary scan line;

a drive transistor configured to generate a drive current corresponding to the data voltage at the first node;

an organic light emission element configured to emit light by the drive current;

a second transistor configured to apply the data voltage on one of the adjacent data lines to the first node in response to a sensing signal on the secondary scan line; and a third transistor configured to detect the sensing voltage and apply the sensing voltage to the other one of the adjacent data lines, in response to the sensing signal on the secondary scan line.

11. The organic light-emitting display device of claim 10, wherein the pixel region further includes a second node connected to a source electrode of the drive transistor and the organic light emission element, and the sensing voltage is a voltage of the second node.

12. The organic light-emitting display device of claim 11, wherein the pixel region further includes a storage capacitor connected between the first and second nodes and configured to maintain the data voltage.

13. The organic light-emitting display device of claim 11, wherein the pixel region further includes a fourth transistor configured to transfer a reference voltage to the second node in response to the scan signal.

* * * * *